US006189777B1

(12) United States Patent
Hutchinson et al.

(10) Patent No.: US 6,189,777 B1
(45) Date of Patent: Feb. 20, 2001

(54) BULK-STORAGE BIN FOR PEANUTS

(75) Inventors: Steve L. Hutchinson, Rome, GA (US); Troy M. Franklin, Princeton, LA (US)

(73) Assignee: Inland Paperboard and Packaging, Inc., Indianapolis, IN (US)

( * ) Notice: Under 35 U.S.C. 154(b), the term of this patent shall be extended for 0 days.

(21) Appl. No.: 09/378,095

(22) Filed: Aug. 20, 1999

Related U.S. Application Data

(60) Provisional application No. 60/097,308, filed on Aug. 20, 1998.

(51) Int. Cl.[7] ..... B65D 5/49

(52) U.S. Cl. ..... 229/120.37; 229/122.32; 229/122.33

(58) Field of Search ..... 229/120.11, 120.37, 229/120.38, 122.32, 122.33, 171

(56) References Cited

U.S. PATENT DOCUMENTS

| | | | | |
|---|---|---|---|---|
| 3,063,615 | * | 11/1962 | Bronte et al. | 229/122.32 |
| 3,701,466 | * | 10/1972 | Woodrow et al. | 229/120.37 |
| 3,744,702 | | 7/1973 | Ellison . | |
| 4,037,775 | * | 7/1977 | Bamburg et al. | 229/120.37 |
| 4,091,983 | | 5/1978 | Booth et al. . | |
| 4,154,387 | | 5/1979 | Booth et al. . | |
| 4,174,803 | * | 11/1979 | Shrontz et al. | 229/122.33 |
| 4,189,086 | | 2/1980 | Booth et al. . | |
| 4,351,471 | * | 9/1982 | Dunkle | 229/120.37 |
| 4,371,109 | * | 2/1983 | Tanner et al. | 229/122.32 |

* cited by examiner

*Primary Examiner*—Gary E. Elkins
(74) *Attorney, Agent, or Firm*—Barnes & Thornburg

(57) ABSTRACT

A container includes a bin including a floor and a bin wall coupled to the floor and arranged to define a carton-receiving region above the floor. The bin wall is made of a corrugated material and includes a top edge positioned to lie in spaced-apart relation to the floor and formed to include top edge openings exposing flutes contained in the corrugated material. The container further includes a first carton positioned to occupy a first portion of the container-receiving region and a second carton positioned alongside the first carton to occupy another portion of the container-receiving region. Each of be cartons includes carton panels arranged to lie adjacent to the bin wall and top flaps appended to the carton panels. The top flaps are arranged to cover the top edge openings exposing flutes contained in the corrugated material formed in the top edge of the bin wall to block flow of storage material into the flutes during discharge of such storage material into interior regions formed in the first and second cartons.

35 Claims, 4 Drawing Sheets

10
103
137
28
11
141
129
110
133
102
3
12
114
104
116
140
132
136
128
166
101
2
26
13
21
20
32
38
144
162
168
120
18
122
158
160
118
17
124
14
155
15
16
23
36
40
44
48
64
157

BULK-STORAGE BIN FOR PEANUTS

This application claims priority under 35 U.S.C. §119(e) to U.S. Provisional Application No. 60/097,308, filed Aug. 20, 1998, which is expressly incorporated by reference herein.

BACKGROUND AND SUMMARY OF THE INVENTION

The present invention relates to a collapsible storage bin, and particularly to collapsible bins made of paperboard. More particularly, the present invention relates to a storage bin made of corrugated material and configured to contain peanuts.

Various types of paperboard bins are used as bulk storage for peanuts. It is important for the storage bins to be sturdy in order to resist "bulging". The bins must also have the ability to be refilled and reused while maintaining the same strength properties. Often times, peanuts or peanut parts can become wedged in any exposed fluting of the paperboard. These trapped peanuts then decay or mold. A storage bin in accordance with the present invention is configured to provide a sturdy, reusable bin having covered fluting.

According to the present invention, a container includes a bin and two cartons placed in a carton-receiving region formed in the bin. Side walls of the bin are made of corrugated material and include top edge openings exposing flutes contained in the corrugated material. Each carton includes carton panels arranged to lie adjacent to the bin side walls and top flaps appended to the carton panels and arranged to cover the top edge openings in the bin side walls. The top flaps on the cartons block flow of storage material such as peanuts, peanut parts, and peanut shells into the flutes during discharge of such storage material into the interior regions formed in the first and second cartons.

In preferred embodiments, the bin includes four bin side walls arranged in series to define the carton-receiving region. First and second cartons are arranged in side-by-side relation to fill the entire carton-receiving region formed in the bin. Three top flaps included in the first carton are folded over the top edge of the first, second, and fourth bin side walls to cover exposed flutes in the top edge openings of that first set of bin side walls and three top flaps included in the second carton are folded over the top edge of the second, third, and fourth bin side walls to cover exposed flutes in the top edge openings of that second set of bin side walls.

The container also includes a middle divider arranged to partition the carton-receiving region and form the boundary between the interior region of the first carton and the interior region of the second carton. A first divider wall included in the first carton and a second divider wall included in the second carton lie in side-by-side relation to one another to define the middle divider.

Each of the first and second divider walls is made of corrugated material and includes top edge openings exposing flutes contained in that corrugated material. A first divider top flap is appended to the first divider wall and folded over the top edge of the adjacent second divider wall and coupled to that second divider wall to cover the top edge openings in the second divider wall and block flow of storage material into the second divider wall flutes. A second divider top flap is appended to the second divider wall and folded over the top edge of the adjacent first divider wall and coupled to that first divider wall to cover the top edge openings in the first divider wall and block flow of storage material into the first divider wall flutes.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figures 1, 10:
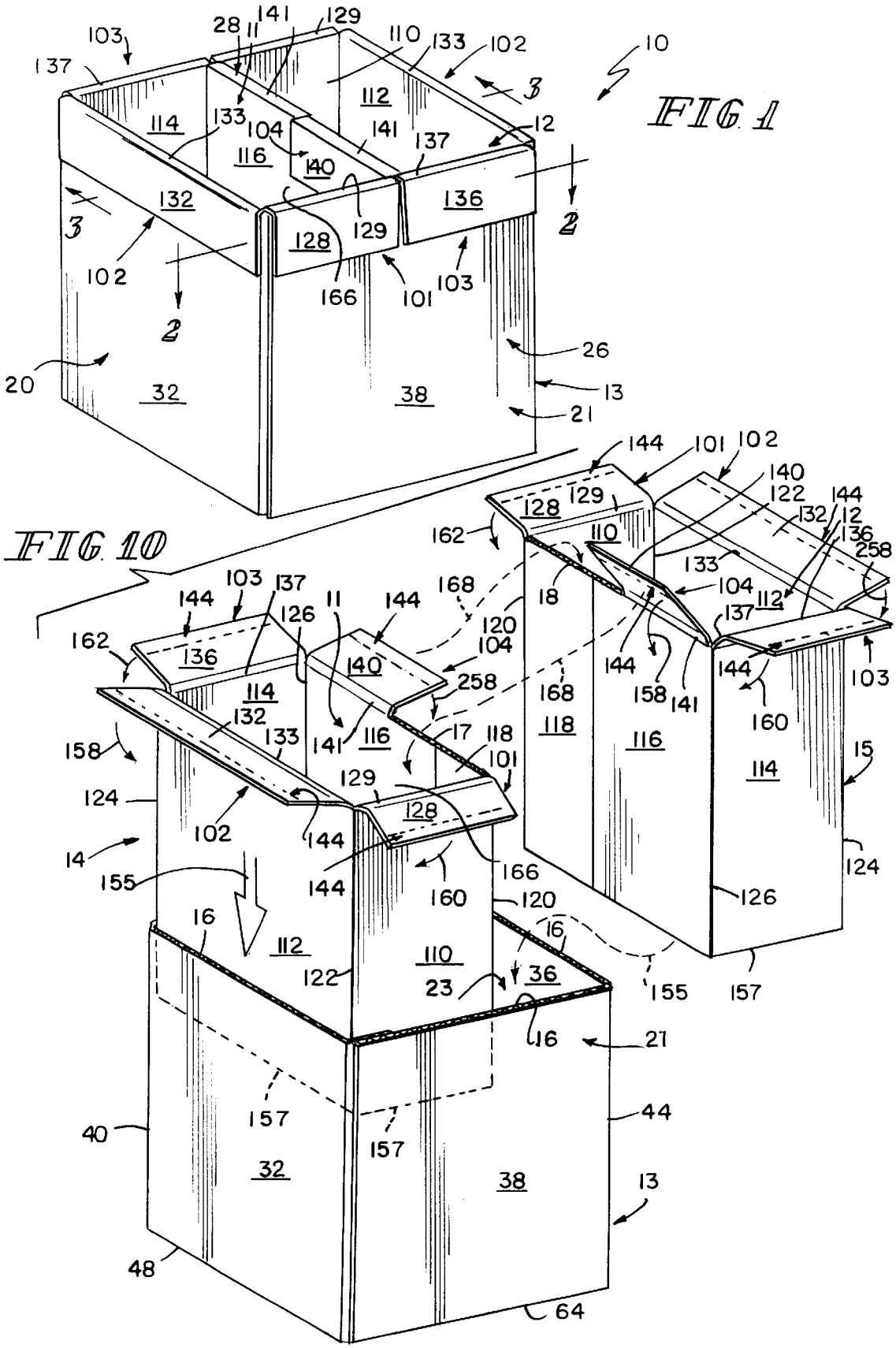
FIG. 1 is a front perspective view of an assembled bulk-storage bin for peanuts in accordance with the present invention showing large top flaps of two inner cartons being folded and glued back to an outer shell of the bin and to divider walls in the cartons in order to cover exposed flutes and provide bulge resistance.
FIG. 10 is a perspective assembly view of two inner cartons formed from two of the second blanks shown in FIG. 6 and the outer shell formed from the first blank shown in FIG. 4 showing the inner cartons being installed within the outer shell in order to provide a bulk-storage peanut bin.

Storage container 10 is formed to include two receptacles 11 and 12 sized to receive and store bulk quantities of peanuts or other goods as shown in FIG. 1. Container 10 includes a bin 13 formed to include a carton-receiving region 23 and first and second cartons 14, 15 configured to fit into the carton-receiving region 23 and provide the first and second receptacles 11, 12 as shown in FIG. 10. The cartons 14, 15 lie in side-by-side relation in bin 13 and outer walls of cartons 14, 15 are positioned to lie adjacent to inner walls of bin 13.

Bin 13 is made of a corrugated material and includes a top edge 16 shown in FIG. 10 formed to include top edge openings exposing flutes contained in the corrugated material used to make bin 13. Each of cartons 14, 15 includes top flaps which are arranged as shown in FIGS. 1 and 10 to cover the top edge openings in top edge 16 of bin 13 when the cartons 14, 15 are mounted in the carton-receiving space 23 of bin 13 as shown in FIG. 1 to block flow of peanuts or peanut parts or shells into the flutes during loading of such items into the peanut receptacles 11, 12 formed in first and second containers 14, 15.

Each carton 14, 15 is also made of a corrugated material. Other top flaps included in the cartons 14, 15 cooperate to cover top edge openings formed in top edge 17 of first carton 14 and top edge 18 of second carton 15 to block flow of peanuts or peanut parts or shells into flutes contained in the corrugated material used to make cartons 14, 15 and exposed by top edge openings formed in top edges 17, 18. Thus, the top flaps included in first and second cartons 14, 15 cooperate to keep foodstuffs out of the flutes in the corrugated material used to form bin 13 and first and second cartons 14, 15.

Figure 2:
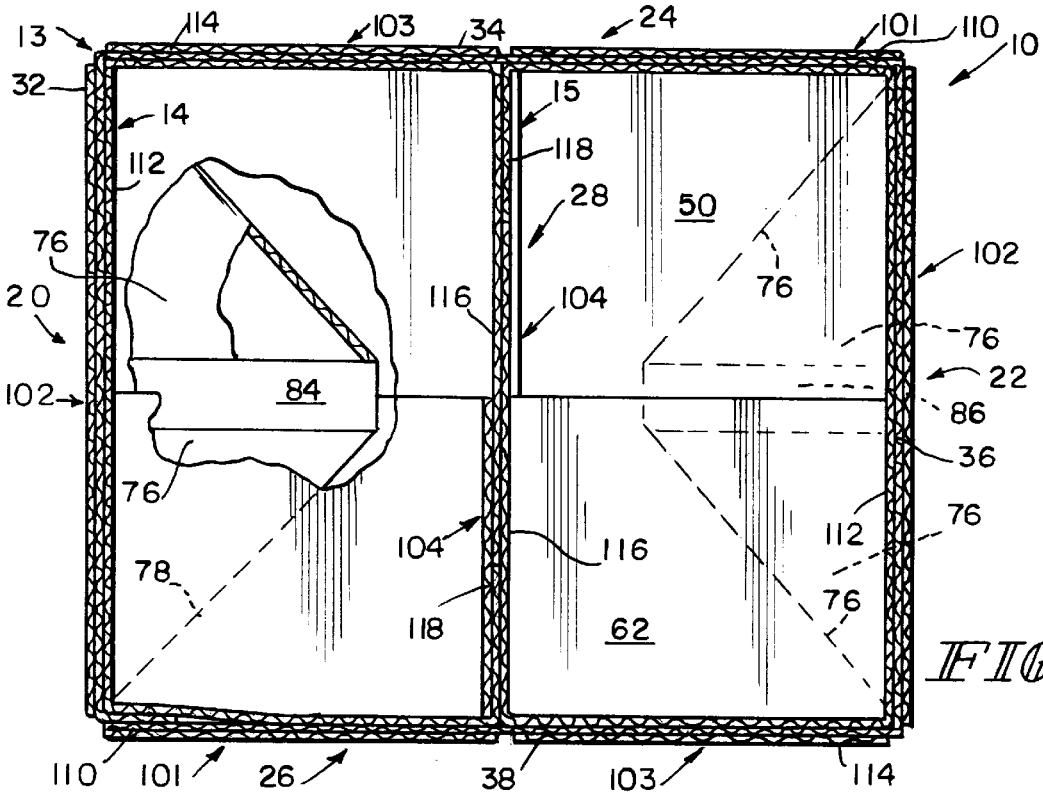
FIG. 2 is a transverse sectional view of the bin of FIG. 1 taken along line 2—2 of FIG. 1, with portions broken away, and showing double-thickness side walls and a double-thickness middle divider, and showing bottom triangle flaps of the bin.
Figure 3:
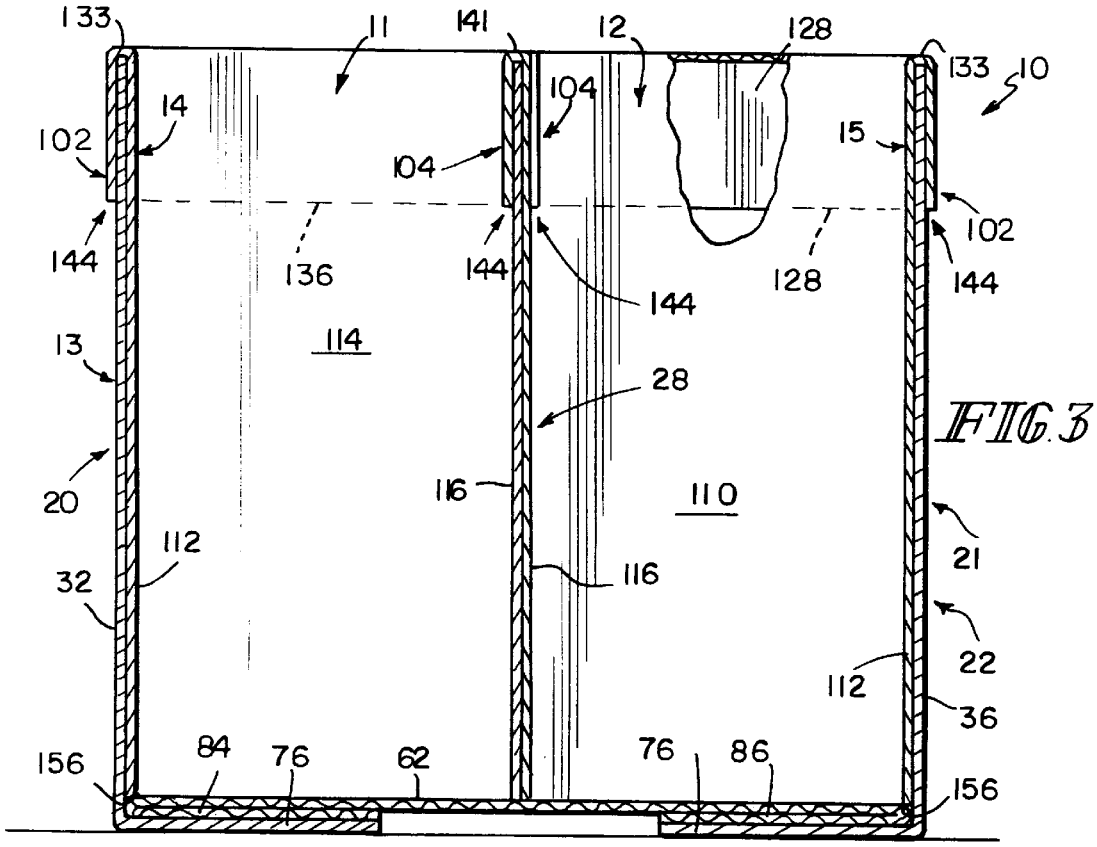
FIG. 3 is a vertical sectional view of the bin of FIG. 1 taken along line 3—3 of FIG. 1, with portions broken away, showing the double-thickness side walls and middle divider and also showing the top flaps of each inner carton being folded over the outer shell of the bin and over the divider walls in the cartons.
Figures 4, 5:
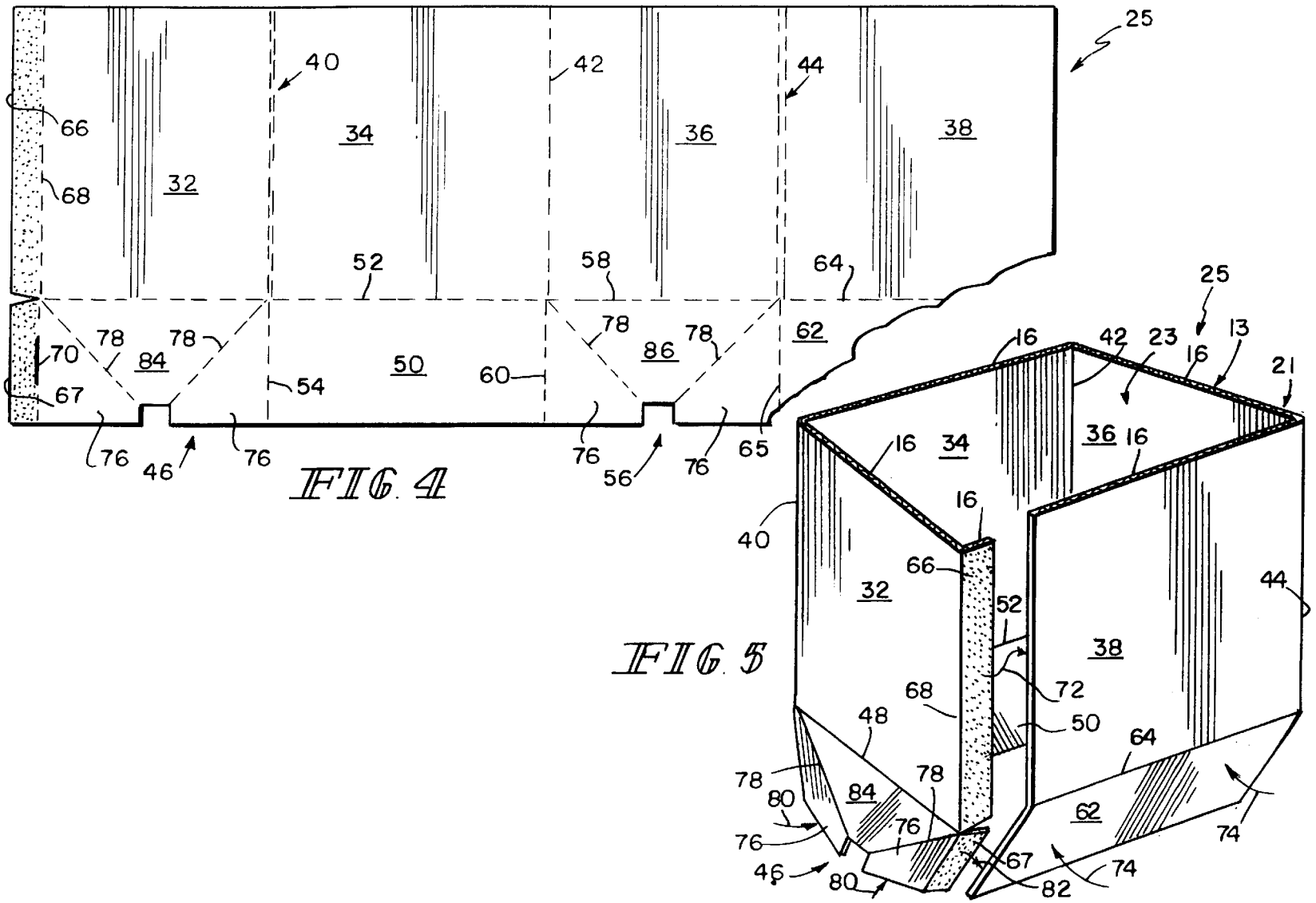
FIG. 4 is a plan view of a first blank of corrugated material used to form the outer shell of the peanut bin of FIG. 1 showing four panels and a shaded inner flap representing an area which is glued prior to assembly.
FIG. 5 is a perspective assembly view showing folding and formation of the blank shown in FIG. 4 to produce the outer shell of the peanut bin.
Figure 6:
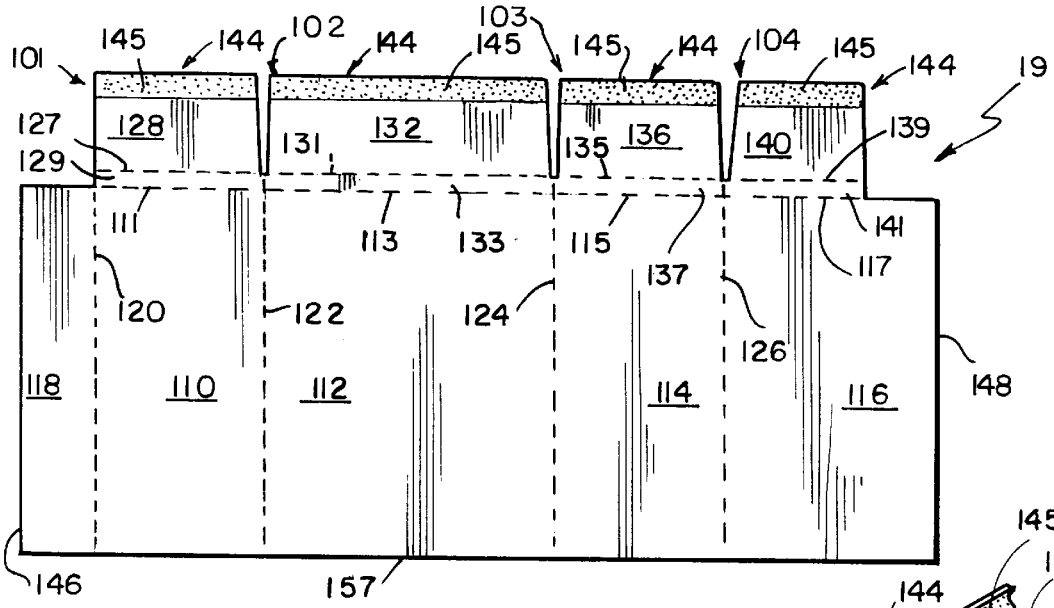
FIG. 6 is a plan view of a second blank of corrugated material used to form each of the two inner cartons included in the peanut bin of FIG. 1 showing four panels each appended to a fold-over top flap.

Bin 13 is made from a first blank 25 of corrugated material, as shown in FIG. 4, and each inner carton 14, 15 is made from a second blank 19 of corrugated material, as shown in FIG. 6. Because bin 13 and inner cartons 14, 15 are used in combination to form storage container 10, storage container 10 includes four double-thickness side walls 20, 22, 24, 26, as shown in FIGS. 2 and 3. A double-thickness middle divider 28 is also formed by positioning first carton 14 in side-by-side relation to second carton 15 in the carton-receiving space 23 formed in bin 13 so that a first divider wall included in first carton 14 cooperates with a second divider wall included in second carton 15 to form middle divider 28.

Referring now to FIG. 4, bin blank 25 is formed to include first, second, third, and fourth bin panels 32, 34, 36, 38. Bin panels 32, 34, 36, 38 are arranged in series when folded relative to one another as shown in FIG. 5 to form a bin wall 21 to define a carton-receiving space 23 therebetween. First bin panel 32 is appended to second bin panel 34 by a double fold line 40, second bin panel 34 is appended to third bin panel 36 by a single fold line 42, and third bin panel 36 is appended to fourth bin panel 38 by a double fold line 44.

Bin blank 16 is also formed to include panels which cooperate to form a floor under bin wall 21. A first outside bottom panel 46 is attached to first bin panel 32 by a fold line 48. A left bottom panel 50 is attached to second bin panel 34 by a fold line 52 and is also attached to outside bottom panel 46 by a fold line 54, as shown in FIG. 4. A second outside bottom panel 56 is attached to third bin panel 36 along a fold line 58 and is also coupled to left bottom panel 50 along a fold line 60. Finally, a right bottom panel 62 is attached to fourth bin panel 38 along a fold line 64 and is attached to second outside bottom panel 56 along a fold line 65.

Inner flaps 66, 67 are provided so that inner flap 66 is attached to first wall panel 32 and inner flap 67 is attached to outside bottom panel 46. Inner flap 66 is attached by a fold line 68 and inner flap 67 is attached by a fold line 70. Inner flaps 66, 67 are shown, by the speckled or shaded area, to be glued prior to assembly.

In order to assemble bin 13, as shown in FIG. 5, bin blank 25 is folded along vertical fold lines 40, 42, 44 so that inner flap 66 may be glued to an inside surface (not shown) of fourth bin panel 38 as indicated by arrow 72. Left and right bottom panels 50, 62 are folded inward along fold lines 52, 64, respectively, as shown by arrows 74. By folding left and right bottom panels 50, 62 inward, side tabs 76 of the first and second outside bottom panels 46, 56 are urged to fold along fold lines 78. This inward folding is represented by arrows 80, as shown in FIG. 5. Inner flap 67 is glued to an inside surface (not shown) of right bottom panel 62 as indicated by arrow 82. Once left and right bottom panels 50, 62 have been folded inward along with inward side tabs 76, two bottom triangle flaps 84, 86 formed by the folding of side tabs 76 of the first and second outside bottom panels 46, 56 are folded along respective fold lines 48, 54 so that triangle flaps 84, 86 are positioned to lie on a bottom side of bin 13, as shown in FIG. 2 (in phantom) and in FIG. 3.

Referring now to FIG. 6, carton blank 19 is formed to include a first end carton panel 110, a first side carton panel 112, a second end carton panel 114, a second side carton panel 116, and a side flap 118. Second side carton panel 116 and side flap 118 cooperate to define a divider wall once a carton is formed from carton blank 19, and that carton is placed in the carton-receiving space 23 in bin 13. Side flap 118 is attached to first end panel 110 along a fold line 120. First end carton panel 110 is attached to first side carton panel 112 along a fold line 122, first side carton panel 112 is similarly attached to second end carton panel 114 along a fold line 124, and second end carton panel 114 is attached to second side carton panel 116 along a fold line 126.

Figure 7:
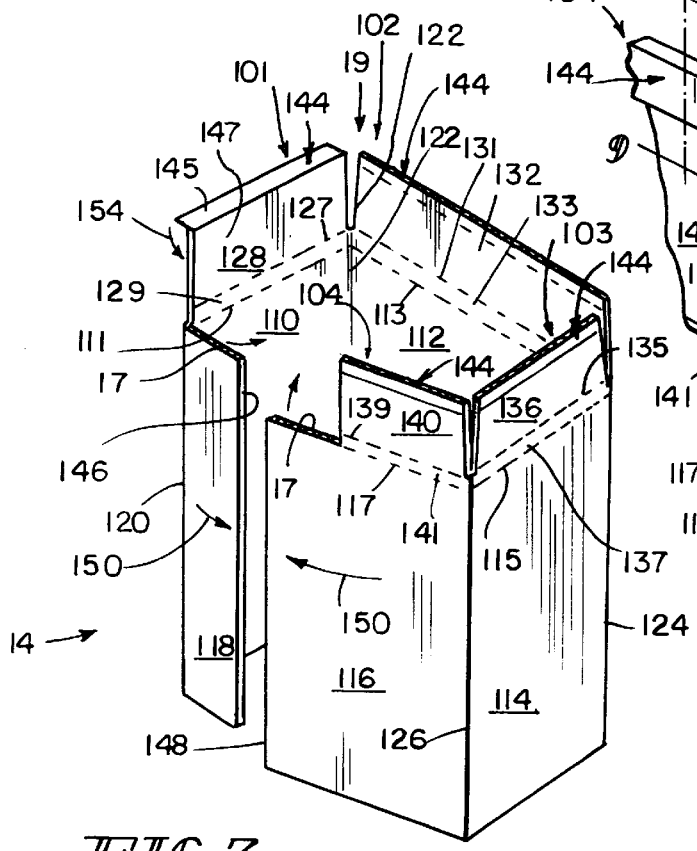
FIG. 7 is a perspective assembly view of the second blank of FIG. 6 as it is being folded and formed to produce one of the inner cartons.

Carton blank 19 also includes four top flaps 101, 102, 103, 104 appended to carton panels 110, 112, 114, 116 as shown, for example, in FIGS. 6 and 7. A first top flap 102 is appended to first side carton panel 112. First top flap 102 includes a mount panel 132 and an edge cover 133 positioned to interconnect mount panel 132 to first side carton panel 112. First top flap 102 is also formed to include a first fold line 113 intermediate first side carton panel 112 and edge cover 133 to facilitate pivotable movement of edge cover 133 about a first fold axis defined by first fold line 113. First top flap 102 further includes a second fold line 131 intermediate edge cover 133 and mount panel 132 to facilitate pivotable movement of mount panel 132 relative to edge cover 133 about a second pivot axis defined by second fold line 131.

Carton blank 19 also includes a second top flap 101 appended to first end carton panel 110 at fold line 111, a third top flap 103 appended to second end carton panel 114 at fold line 115, and a fourth top flap 104 appended to the second side carton panel 116 included in divider wall 116, 118 at fold line 117 as shown in FIGS. 6 and 7. Second top flap 101 includes edge cover 129 appended to first end carton panel 110 at fold line 111 and to a mount panel 128 at fold line 127. Third top flap 103 includes edge cover 137 appended to second end carton panel 114 at fold line 115 and to a mount panel 136 at fold line 135. Fourth top flap 104 includes edge cover 141 appended to second side carton panel 116 at fold line 117 and to a mount panel 140 at fold line 139.

In order to assemble one of the inner cartons 14, as shown in FIG. 7, carton blank 19 is folded along vertical fold lines 120, 122, 124, 126 so that an outside edge 146 of side flap 118 is positioned to align with and engage an outside edge 148 of second side carton panel 116. As shown by arrows 150 in FIG. 7, side flap 118 and second side carton panel 116 are folded toward each other along respective fold lines 120, 126. Once side flap 118 and second side panel 116 are aligned with each other, inner carton 114 is formed.

Figure 8:
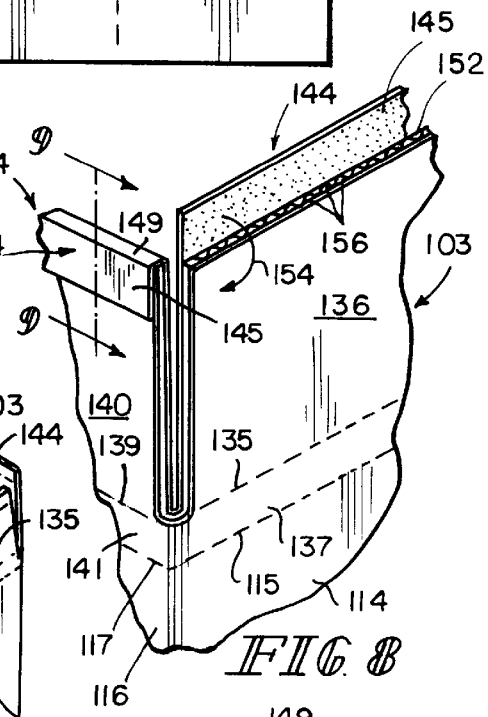
FIG. 8 is an enlarged view of a portion of the inner carton shown in FIG. 7, with portions broken away, showing a thin liner (covered with adhesive) that is arranged in order to be folded over a fluted edge of the corrugated material to close openings in the flutes of the corrugated material.
Figure 9:
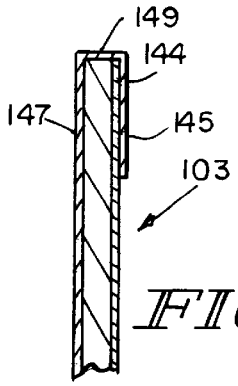
FIG. 9 is a sectional view taken along line 9—9 of FIG. 8 showing the liner after the liner has been folded down over the edge in order to cover the exposed fluting.

As shown in FIGS. 7–9, liners 144 are formed to fold over an exposed edge 152 in direction 154 in order to cover fluting 156 included in the top flaps 101, 102, 103, and 104.

Referring to FIGS. 8 and 9, top flap 103 includes a distal edge 152 formed to include a distal edge opening exposing flutes 156 contained in the corrugated material used to make top flap 103. Liner 144 includes an inner portion 145, an outer portion 147, and an edge portion 149 interconnecting the inner and outer portions 145, 147 and covering the distal edge openings and the flutes 156 therein.

Referring now to FIG. 10, peanut container 10 is assembled by placing two inner cartons 14, 15 within the container-receiving region 23 of bin 13, as shown by arrows 155. Inner cartons 14, 15 are placed within bin 13 so that first side panel 112 of inner cartons 14 is positioned to lie adjacent to and in engagement with bin panel 32 and first side carton panel 112 of inner carton 15 is positioned to lie adjacent to and in engagement with bin panel 36. Both inner cartons 14, 15 are placed within carton-receiving region 23 of bin 13 and moved in direction 155 until a bottom edge 157 of each inner carton 14, 15 engages left and right bottom panels 50, 62 of bin 13. Each second side carton panel 116 and side flap 118 of inner cartons 14, 15 are positioned to lie adjacent to and in engagement with each other in order to form middle divider 28, as shown in FIGS. 2 and 3. Inner cartons 14, 15 are glued to each other and to an inside surface of each wall panel 32, 34, 36, 38 of bin 13.

Once inner cartons 14 have been positioned within bin 13, top flaps 101, 102, and 103 are folded over the top edge 16 of bin 13 in order to provide extra bulge resistance and to cover exposed fluting of bin 13. As shown and suggested in FIGS. 1 and 10, with respect to first carton 14, top flap 102 is folded in direction 158 and mount panel 132 is coupled (e.g., glued or stapled) to bin wall 32 so that edge portion 133 covers the exposed flutes in top edge 16 of bin wall 32. Top flap 101 is folded in direction 160 and mount panel 128 is coupled to bin wall 38 so that edge portion 129 covers a first portion of the exposed flutes in top edge 16 of bin wall 38. Top flap 103 is folded in direction 162 and mount panel 136 is coupled to bin wall 34 so that edge portion 137 covers a first portion of the exposed flutes in top edge 16 of bin wall 34.

As shown and suggested in FIGS. 1 and 10, with respect to second carton, top flap 102 is folded in direction 258 and mount panel 132 is coupled to bin wall 36 so that edge portion 133 covers the exposed flutes in top edge 16 of bin wall 36. Top flap 103 is folded in direction 160 and mount panel 136 is coupled to bin wall 38 so that edge portion 137 covers a remaining second portion of exposed flutes in top edge 16 of bin wall 38. Top flap 101 is folded in direction 162 and mount panel 128 is coupled to bin wall 34 so that edge portion 129 covers a remaining second portion of exposed flutes in top edge 16 of bin wall 34.

As shown in FIGS. 1 and 10, with respect to middle divider 28, top flap 104 of first carton 14 is folded in direction 258 and mount panel 140 is coupled to a second divider wall 116, 118 in second carton 15 so that edge portion 141 covers exposed flutes in top edge 18 of second divider wall 116, 118. Top flap 104 of second carton 15 is folded in direction 158 and mount panel 140 is coupled to a first divider wall 116, 118 in first carton so that edge portion 141 covers exposed flutes in top edge 17 of first divider wall 116, 118.

As shown in FIGS. 1, 2, and 3, fully assembled peanut storage container 10 is formed to include double-thickness side walls 20, 22, 24, 26 having top flaps 101, 102, 103, 104 folded over to act as reinforcement for side walls 20, 22, 24, 26. Referring now to FIGS. 2 and 3, a first side wall 20 is formed by bin panel 32 of bin 13 and first side carton panel 112 of inner carton 14. A second side wall 22 is formed by bin panel 36 of bin 13 and first side carton panel 112 of inner carton 15. A third side wall 24, as shown in FIG. 2, is formed to include bin panel 34 of bin 13 and first and second end panels 110, 114 of respective adjacent inner cartons 14, 15, while a fourth side wall 26 is formed to include bin panel 38 of bin 13 and first and second end panels 110, 114 of respective adjacent inner cartons 14, 15. Middle divider 28 is formed to have a double-thickness with added reinforcement from top flaps 104. Double-thickness side walls 20, 22, 24, 26 are provided to increase the stacking strength of storage container 10 so that storage container 10 may be stacked on top of each other during shipping.

By providing storage container 10 having a high bulge resistance due to double-thickness side walls 20, 22, 24, 26 and double-thickness middle divider 28, bulk quantities of peanuts may be packaged for shipping. Top flaps 101, 102, 103, 104 also cooperate to increase the bulge resistance of container 10 while acting to cover the exposed fluting of bin panels 32, 34, 36, 38 of bin 13. Thin liners 144 are provided to cover fluting 156 of exposed distal edges 152 of top flaps 101, 102, 103, 104.

Although the invention has been described in detail with reference to preferred embodiments, variations and modifications exist within the scope and spirit of the invention as described and defined in the following claims.

What is claimed is:

1. A container comprising a bin including a floor and a bin wall coupled to the floor and arranged to define a carton-receiving region above the floor, the bin wall being made of a corrugated material and including a top edge positioned to lie in spaced-apart relation to the floor and formed to include top edge openings exposing flutes contained in the corrugated material, a first carton positioned to occupy a first portion of the carton-receiving region, and a second carton positioned alongside the first carton to occupy another portion of the carton-receiving region, each of the first and second cartons including carton panels arranged to lie adjacent to the bin wall and top flaps appended to the carton panels and arranged to cover the top edge openings exposing flutes contained in the corrugated material formed in the top edge of the bin wall to block flow of storage material into the flutes during discharge of such storage material into interior regions formed in the first and second cartons.

2. The container of claim 1, wherein each top flap includes a mount panel adhered to the bin wall and an edge cover positioned to interconnect the mount panel and a companion carton panel and the edge cover is arranged to cover the top edge openings exposing flutes contained in the corrugated material.

3. The container of claim 2, wherein the bin wall includes an inner surface facing into the carton-receiving region and an outer surface facing away from the carton-receiving region and the mount panel is adhered to the outer surface of the bin wall.

4. The container of claim 3, wherein the edge cover is positioned to overlie a portion of the top edge openings and lie in perpendicular relation to the mount panel.

5. The container of claim 3, wherein the companion carton panel abuts the inner surface of the bin wall and lies in perpendicular relation to the edge cover.

6. The container of claim 2, wherein each top flap is formed to include a first fold line intermediate the companion carton panel and the edge cover to facilitate pivotable movement of the edge cover relative to the carton panel about a first pivot axis defined by the first fold line and a second fold line intermediate the edge cover and the mount panel to facilitate pivotable movement of the mount panel relative to the edge cover, about a second pivot axis defined by the second fold line.

7. The container of claim 6, wherein the first and second fold lines are arranged to lie in spaced-apart parallel relation one to another.

8. The container of claim 2, wherein each mount panel is positioned to lie in spaced-apart parallel relation to a companion carton panel and in perpendicular relation to the edge cover interconnecting the mount panel and the companion carton panel.

9. The container of claim 8, wherein each top flap is made of a corrugated material and includes a distal edge formed to include distal edge openings exposing flutes contained in the corrugated material and further comprising a liner coupled to each top flap and arranged to cover distal edge openings.

10. The container of claim 2, wherein each top flap is made of a corrugated material and includes a distal edge formed to include distal edge openings exposing flutes contained in the corrugated material and further comprising a liner coupled to each top flap and arranged to cover distal edge openings.

11. The container of claim 10, wherein each mount panel includes a first surface adhered to the bin wall and a second surface arranged to face away from the bin wall and the liner includes an inner portion coupled to the first surface, an outer portion coupled to the second surface, and an edge portion interconnecting the inner and outer portions and covering the distal edge openings.

12. The container of claim 1, wherein the first carton further includes a first divider wall coupled to two of the carton panels of the first carton and arranged to lie in perpendicular relation to the floor of the bin and the second carton further includes a second divider wall coupled to two of the carton panels of the second carton and arranged to lie in perpendicular relation to the floor of the bin and in confronting parallel relation to the first divider wall.

13. The container of claim 12, wherein each of the first and second divider walls is made of corrugated material and includes a top edge positioned to lie in spaced-apart relation to the floor and formed to include top edge openings contained in the corrugated material forming the first and second divider walls, the first carton further includes a first top flap appended to the first divider wall and arranged to cover the top edge openings formed in the second divider wall, and the second carton further includes a second top flap appended to the second divider wall and arranged to cover the top edge openings formed in the first divider wall.

14. The container of claim 13, wherein the first top flap includes an edge cover arranged to cover the top edge openings formed in the second divider wall and a mount panel adhered to the second divider wall and the first top flap is formed to include a first fold line intermediate the first divider wall and the edge cover to facilitate pivotable movement of the edge cover relative to the first divider wall about a first pivot axis defined by the first fold line and a second fold line intermediate the edge cover and the mount panel to facilitate pivotable movement of the mount panel relative to the edge cover about a second pivot axis defined by the second fold line.

15. The container of claim 12, wherein the first carton further includes a first divider top flap appended to the first divider wall and adhered to the second divider wall.

16. The container of claim 15, wherein the second divider wall includes an inner surface facing into an interior region formed in the second carton and an outer surface facing toward the first carton and the first divider top flap is adhered to the inner surface of the second divider wall.

17. The container of claim 15, wherein the second carton further includes a second divider top flap appended to the second divider wall and adhered to the first divider wall.

18. The container of claim 17, wherein the first divider wall includes an inner surface facing into an interior region formed in the first carton and an outer surface facing toward the second carton and the second divider flap is adhered to the inner surface of the first divider.

19. The container of claim 15, wherein the second divider wall is made of a corrugated material, the second divider wall includes a second divider top edge positioned to lie in spaced-apart relation to the floor and formed to include second divider top edge openings exposing flutes contained in the corrugated material forming the second divider wall, and the first divider top flap is arranged to cover the second divider top edge openings to block flow of storage material into the flutes in the second divider wall during discharge of such storage material into the interior regions formed in the first and second cartons.

20. The container of claim 19, wherein the first divider wall is made of a corrugated material, the first divider wall includes a first divider top edge positioned to lie in spaced-apart relation to the floor and formed to include first divider top edge openings exposing flutes contained in the corrugated material forming the first divider wall, and the second divider top flap is arranged to cover the first divider top edge openings to block flow of storage material into the flutes in the first divider wall during discharge of storage material into the interior regions formed in the first and second cartons.

21. A container comprising a bin including a floor, a first side bin panel coupled to the floor, a third side bin panel coupled to the floor to lie opposite to the first side bin panel, and second and fourth side bin panels coupled to the floor and positioned to lie between the first and third side body panels, the first, second, third, and fourth side bin panels being arranged in series to define a carton-receiving region above the floor, each side bin panel being made of a corrugated material and including a top edge positioned to lie in spaced-apart relation to the floor and formed to include top edge openings exposing flutes contained in the corrugated material, a first carton positioned to occupy a first portion of the carton-receiving region and cover top edge openings formed in a first set of the side bin panels to block flow of storage material into flutes in the first set of the side panels during discharge of such storage material into an interior region formed in the first carton, and a second carton positioned to occupy another portion of the carton-receiving region and cover top edge openings formed in a second set of the side bin panels to block flow of storage material into flutes in the second set of the side bin panels during discharge of such storage material into an interior region formed in the first carton.

22. The container of claim 21, wherein the first set includes the first, second, and fourth side bin panels.

23. The container of claim 22, wherein the first carton covers the top edge opening formed in the first side bin panel, a first portion of the top edge opening formed in the second side bin panel, and a first portion of the top edge opening formed in the fourth side bin panel.

24. The container of claim 23, wherein the second set includes the second, third, and fourth side bin panels and the second carton covers a second portion of the top edge opening formed in the second side bin panel, the top edge opening formed in the third side bin panel, and a second portion of the top edge opening formed in the fourth side bin panel.

25. The container of claim 22, wherein the second set includes the second, third, and fourth side bin panels.

26. The container of claim 21, wherein the first carton includes a first side carton panel arranged to lie adjacent to the first side bin panel and a first top flap appended to the first side carton panel and arranged to cover the top edge opening in the first side bin panel.

27. The container of claim 26, wherein the first top flap includes a mount panel adhered to the first side bin panel and an edge cover positioned to interconnect the mount panel and the first side carton panel and the edge cover is arranged to cover the top edge opening in the first side bin panel.

28. The container of claim 27, wherein the first side bin panel includes an inner surface facing toward the first side carton panel and an outer surface facing away from the first side carton panel and the mount panel is adhered to the outer surface of the first side bin panel.

29. The container of claim 27, wherein the first top flap is formed to include a first fold line intermediate the first side carton panel and the edge cover to facilitate pivotable movement of the edge cover relative to the first side carton panel about a first fold axis defined by the first fold line and a second fold line intermediate the edge cover and the mount panel to facilitate pivotable movement of the mount panel relative to the edge cover about a second pivot axis defined by the second fold line.

30. The container of claim 26, wherein the first carton further includes a first end carton panel arranged to lie adjacent to the second side bin panel and a second top flap appended to the first end carton panel and arranged to cover a first portion of the top edge opening in the second side bin panel.

31. The container of claim 30, wherein the first carton further includes a second end carton panel arranged to lie adjacent to the fourth side body panel and a third top flap appended to the second end carton panel and arranged to cover a first portion of the top edge opening in the fourth side body panel.

32. The container of claim 26, wherein the first carton further includes a first divider wall arranged to lie in spaced-apart parallel relation to the first side carton panel, the first divider wall is made of corrugated material and includes a top edge positioned to lie in spaced-apart relation to the floor and formed to include a top edge opening exposing flutes contained in the corrugated material forming the first divider wall, and the second carton includes a second divider wall arranged to lie adjacent to the first divider and a top flap appended to the second divider wall and arranged to cover the top edge opening of the first divider wall to block flow of storage material into the flutes in the first divider wall during discharge of storage material into the interior regions formed in the first and second cartons.

33. The container of claim 32, wherein the second divider of the second carton is made of a corrugated material and includes a top edge positioned to lie in spaced-apart relation to the floor and formed to include a top edge opening exposing flutes contained in the corrugated material forming the second divider wall, and the first carton further includes a top flap appended to the first divider wall and arranged to cover the top edge opening of the second divider wall to block flow of storage material into flutes in the second divider wall during discharge of storage material into interior regions formed in the first and second cartons.

34. The container of claim 26, wherein the first top flap is made of a corrugated material and includes a distal edge formed to include a distal edge opening exposing flutes in the first top flap and further comprising a liner coupled to the first top flap and arranged to cover the distal edge opening.

35. A container comprising a bin including a floor and first, second, third, and fourth bin panels coupled to the floor and arranged in series to define a carton-receiving region, each bin panel being made of corrugated material and including a top edge positioned to lie in spaced-apart relation to the floor and formed to include top edge openings exposing flutes contained in the corrugated material, and first and second cartons lying in side-by-side relation in the carton-receiving region formed in the bin, each carton including carton panels arranged to lie adjacent to the bin panels, top flaps appended to the carton panels and arranged to cover the top edge openings in the bin panels, a divider wall arranged to partition the container-receiving region, each divider wall being made of corrugated material and including a top edge positioned to lie in spaced-apart relation to the floor and formed to include top edge openings exposing flutes contained in the corrugated material forming the divider walls, a first top flap appended to the divider wall of the first carton and arranged to cover the top edge opening in the divider wall of the second carton, and a second top flap appended to the divider wall of the second carton and arranged to cover the top edge opening in the divider wall of the first carton.

* * * * *